United States Patent [19]

Gerry

[11] 4,286,391

[45] Sep. 1, 1981

[54] CONTROL SYSTEM FOR AN AUTOMATIC CLOTHES DRYER

[75] Inventor: Otto F. Gerry, Louisville, Ky.

[73] Assignee: General Electric Company, Louisville, Ky.

[21] Appl. No.: 120,183

[22] Filed: Feb. 11, 1980

[51] Int. Cl.[3] ..... F26B 21/10

[52] U.S. Cl. ..... 34/44; 34/48; 34/55

[58] Field of Search ..... 34/48, 46, 53, 55, 133, 34/44

[56] References Cited

U.S. PATENT DOCUMENTS

| | | | |
|---|---|---|---|
| 3,100,144 | 8/1963 | Berenbaum et al. | 34/45 |
| 3,699,665 | 10/1972 | Shinskey | 34/48 |
| 3,787,985 | 1/1974 | Fowler et al. | 34/45 |
| 4,019,259 | 4/1977 | Veraart | 34/48 |
| 4,112,589 | 9/1978 | Palfrey et al. | 34/48 |
| 4,206,552 | 6/1980 | Pomerantz et al. | 34/48 |
| 4,209,915 | 7/1980 | Keuleman | 34/48 |

*Primary Examiner*—Larry I. Schwartz

*Attorney, Agent, or Firm*—H. Neil Houser; Radford M. Reams

[57] ABSTRACT

Inlet and outlet air temperatures are provided to a preprogrammed microcomputer first to maintain the inlet air temperature at a fixed value and second to sense when the outlet air temperature has risen above a sensed plateau value on the outlet air temperature characteristic curve by a predetermined percentage factor. This percentage factor is used to determine from the plateau temperature the temperature value at which the drying cycle is to be terminated. In this way, the drying cycle is terminated at a particular percentage moisture content in the clothes load irrespective of the size of the clothes load being dried.

4 Claims, 2 Drawing Figures

CONTROL SYSTEM FOR AN AUTOMATIC CLOTHES DRYER

BACKGROUND OF THE INVENTION

This invention relates to automatic clothes dryers and more specifically to control systems therefor designed to terminate the clothes drying cycle when the percentage of moisture retained in the clothes load has declined to a level of dryness desired by the user.

In present day commercially available automatic clothes dryers, it is common practice to provide an electromechanical timer by which the user may set the drying time to a value that the user expects will result in a desired degree of dryness for the particular clothes load involved. Although the timer dial is generally provided with markings intended to assist the user in selecting the proper amount of dryer time, the user is generally left with a need to estimate, based on experience, the amount of time needed to dry a particular load. It is known, however, that the required amount of drying time is dependent on such factors as the particular design of the dryer, the amount of heat acquired via the dryer air flowing through the dryer, the size of the clothes load, and the moisture content of the clothes load at the beginning of the drying cycle. U.S. Pat. No. 4,019,259 teaches that for a given temperature of inlet air to the dryer, a family of time temperature characteristic curves may be derived, each of which exhibits a substantially constant temperature plateau at a temperature value which is a function of the clothes load size. Thus a small clothes load exhibits a constant temperature plateau which is higher than a larger clothes load. The patent goes on to disclose an electromechanical control system for terminating clothes dryer operation based on the amount of time calculated electromechanically by the cooling effect of the clothes load. In effet, the duty cycle of a thermostatic switch is varied for a shorter dryer time with small loads than with larger loads.

Electromechanical arrangements of the type involved in the foregoing device are subject to long term reliability problems associated with repeated operation. Accuracy of control can also be a problem dependent upon the closeness with which the thermostatic switches can be manufactured to design specifications. Moreover, the approach suggested by the U.S. Pat. No. 4,019,259 assumes that a given drying time for a given clothes load dryer air temperature plateau will result in a desired degree of dryness of the clothes load. This is a predictive form of control which, although not necessarily entirely unsatisfactorily, does not assure that a particular dryness level is in fact reached when the dryer cycle is terminated.

It is, therefore, an object of the present invention to provide a control system for an automatic clothes dryer which obviates the problems associated with electromechanical controls.

It is a further object of the present invention to provide a control system for an automatic clothes dryer which provides a more positive form of dryer termination control than heretofore available with electromechanical control arrangements.

SUMMARY OF THE INVENTION

In accordance with the present invention, there is provided a control system for an automatic clothes dryer of the type having a clothes drying drum, an air inlet to the drum, an air outlet from the drum, means for flowing dryer air through the drum and heater means for heating the dryer air at the air inlet side of the drum. The control system of the invention comprises means for sensing the temperature of the dryer air at the inlet side of the drum and means responsive to inlet air temperature sensing means for controlling the heater means to maintain the inlet air at a predetermined substantially constant temperature. The control system further includes means for sensing the temperature of the dryer air at the outlet side of the drum, the outlet temperature having a time temperature characteristic which is substantially constant over a major portion of the drying cycle at an absolute value dependent on the size of the clothes load and which rises near the end of the drying cycle. The control system still further includes means responsive to the outlet air temperature for initiating termination of the drying cycle when the sensed outlet temperature rises above the constant value of the time temperature characteristic curve by a predetermined percentage factor, this percentage factor being essentially the same for the dryer irrespective of the absolute value of the constant temperature level sensed by the outlet air temperature sensing means. As a result, the outlet air temperature is constantly monitored to provide a direct control of the point at which the drying cycle is terminated.

DETAILED DESCRIPTION

Figure 1:
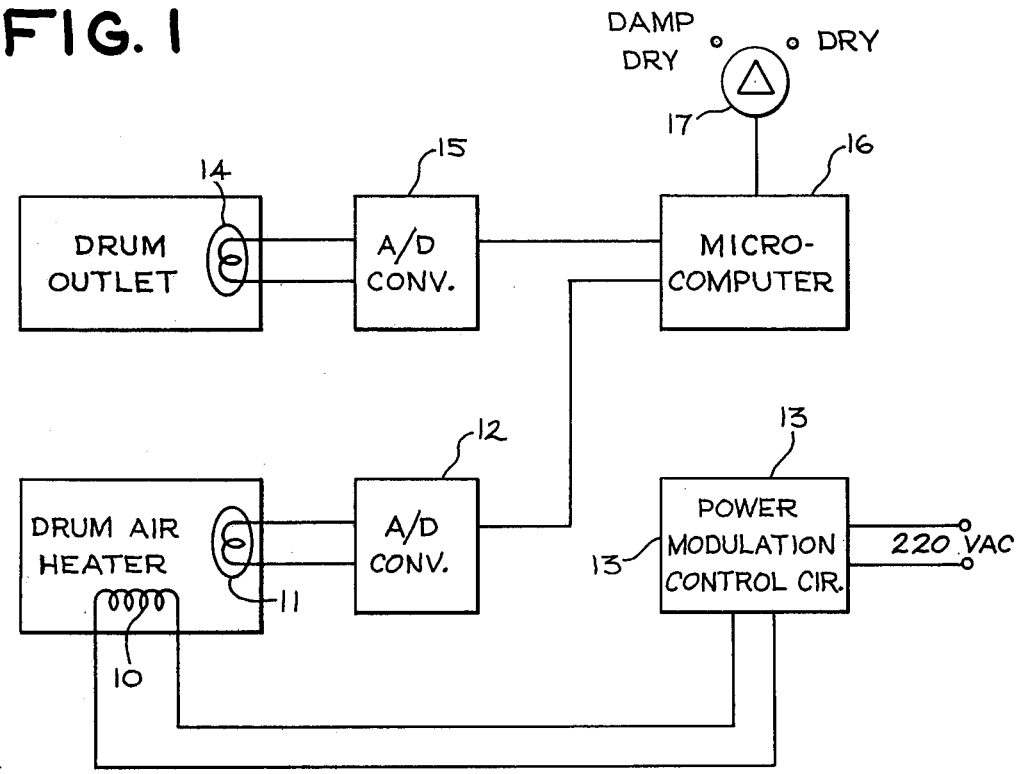
FIG. 1 is a schematic block diagram of a control system for an automatic clothes dryer illustrating the basic structure of the present invention.

Referring to FIG. 1, a control system is shown for use with an automatic clothes dryer wherein the dryer itself may be of any well known construction having a clothes drying drum, an air inlet to the drum, an air outlet from the drum, and air mover or blower for flowing dryer air through the drum. Generally as is well known, heat means, for example, an electrical resistance heater 10 may be provided for heating the dryer air at the air inlet side of the drum in well known manner.

Means such as thermistor 11 are provided for sensing the temperature of the dryer air at the inlet side of the drum. Preferably, thermistor 11 is placed in any convenient position within the inlet air flow so as to sense the temperature of the air flow without being directly influenced by direct radiation from the heater means 10. A suitable shield for this purpose may be provided. The output of thermistor 11 is coupled through an analog to digital converter 12 through a suitable control circuit in microcomputer 16 to power modulation control circuit 13 which in turn is coupled to the heater means 10 and is responsive to the inlet air temperature sensed by thermistor 11 to control the heater means 10 to maintain the inlet air at a predetermined substantially constant temperature. The particular inlet air temperature is determined in accordance with the overall design of the dryer and may, for example, be 250 degrees F. In well known manner, this value may be programmed into microcomputer 16 such that any deviation therefrom during the drying cycle may generate a control to power modulation control circuit 13 which may, for example, comprise a conventional zero voltage control triac switching circuit to cycle the operation of heater means 10 so as to maintain a constant inlet air temperature.

Figure 2:
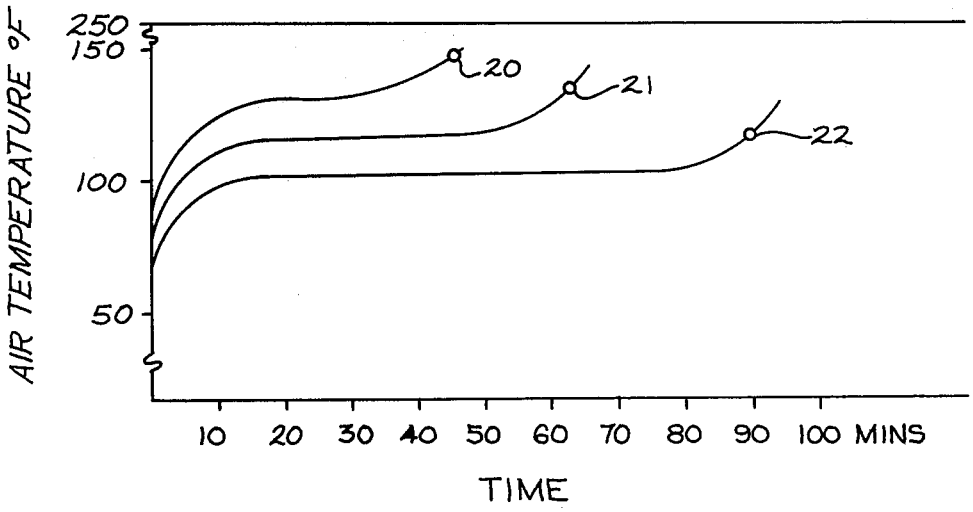
FIG. 2 is a graph illustrating a plurality of time temperature curves for a clothes dryer for different sized clothes loads drying operations.

Means for sensing the temperature of the dryer air at the outlet side of the drum includes thermistor 14. As previously described, the outlet air temperature exhibits a time temperature characteristic which is substantially constant over a major portion of the drying cycle at an absolute value dependent on the size of the clothes load. Thus with reference to FIG. 2, a family of outlet air temperature curves is illustrated respectively for clothes loads of two pounds, seven pounds and 12 pounds. Generally it can be shown that as the percentage moisture content of the clothes load declines to a given value such as below 15%–20% depending on fabric and ambient conditions, the curve begins to rise. It has been found through empirical testing that a given point on these curves may be determined to represent a desired percentage moisture content of the clothes load. This point on the curve which represents a particular temperature value may be shown to be at a particular value which is above the constant temperature value of its associated characteristic temperature curve by a fixed percentage amount, which percentage amount or factor is the same as applied to each temperature characteristic curve irrespective of the actual temperatures involved. Thus, in one particular model in which these temperature characteristic curves were developed, the temperature at which a 4% moisture content for each of three different clothes load sizes of two pounds, seven pounds and twelve pounds, respectively, was found to be in the range of 8% to 10% above the constant or plateau temperature for the clothes load involved. These temperature values are illustrated by points 20, 21 and 22 in FIG. 2.

With the foregoing in mind and in accordance with the invention, microcomputer 16 is programmed in accordance with well known techniques to be responsive to thermistor 14 via analog to digital converter 15. Microcomputer 16 is, therefore, responsive to the outlet air temperature to intitiate termination of the drying cycle when the sensed outlet temperature rises above a constant value occurring in the outlet air temperature characteristic curve by a predetermined percentage factor. Thus, microcomputer 16 is programmed to receive the temperature readings from hermistor 14 and to determine therefrom when the plateau temperature has been reached and the actual value of this plateau temperature. When this plateau temperature has been determined, the predetermined percentage factor is then applied to the plateau temperature to determine the outlet air temperature at which the drying cycle is to be terminated. Since the outlet air temperature is continually sensed by microcomputer 16, when this predetermined temperature value is reached, microcomputer 16 terminates the drying cycle. Termination of the drying cycle may be accomplished in any well known manner generally by terminating the operation of heater means 10 followed by, for example, a cool-down cycle wherein the dryer drum continues to rotate for a period of time while cool air is flowed through the drum.

In some cases, it may be desirable to provide user selected degrees of dryness and for this purpose, a user-operated control 17 is coupled to microcomputer 16 to select the percentage factor from a plurality of empirically derived factor values stored in memory in microcomputer 16 to be applied to the sensed plateau temperature. In most cases, a percentage moisture content of 4% represents a fully dried condition. A damp dry condition might represent for example a 10% moisture content in which case the microcomputer has stored within memory a lower percentage factor associated with this percentage moisture to be applied to the plateau temperature for use in determining the actual sensed temperature at which the dryer cycle is to be terminated. This might, for example, be a percentage factor of 2% above the plateau temperature or 102% of the plateau temperature.

While, in accordance with the patent statutes, there has been described what at present is considered to be a preferred embodiment of the invention, it will be obvious to those skilled in the art that various changes and modifications may be made therein without departing from the invention. It is, therefore, intended by the appended claims to cover all such changes and modifications as fall within the true spirit and scope of the invention.

What is claimed is:

1. A control system for an automatic clothes dryer of the type having a clothes drying drum, an air inlet to the drum, an air outlet from the drum, means for flowing dryer air through the drum and heater means for heating the dryer air at the air inlet side of the drum, the system comprising:

means for sensing the temperature of said dryer air at the inlet side of the drum;

means responsive to the inlet air temperature sensing means for controlling the heater means to maintain the inlet air at a predetermined substantially constant temperature;

means for sensing the temperature of said dryer air at the outlet side of the drum, the outlet temperature having a time-temperture characteristic which is substantially constant over a major portion of the drying cycle at an absolute value dependent on the size of the clothes load and which rises near the end of the drying cycle;

and means responsive to the outlet air temperature for initiating termination of the drying cycle when the sensed outlet temperature rises above said constant time-temperature value by a predetermined percentage factor, said percentage factor being essentially the same for said dryer irrespective of the absolute value of the sensed constant outlet temperature.

2. The dryer control system of claim 1 in which the outlet air temperture responsive means includes means for determining when the outlet air temperature has reached its substantially constant value and for determining from this constant value the outlet air temperature value which, when sensed, will cause said outlet air temperature responsive means to initiate termination of the drying cycle.

3. The dryer control system of claim 1 or claim 2 in which the system includes user operated means for establishing a control effect representative of the desired degree of dryness for the clothes load, and the outlet temperature responsive means is further responsive to the user operated means to select a predetermined percentage factor corresponding to the user selected dryness condition, which desired percentage factor is the same irrespective of the clothes load size.

4. The dryer control system of claim 1 or claim 2 in which the outlet air temperature responsive means terminates operation of the heater means when the outlet air temperature rises above said constant time-temperature value by said predetermined percentage factor.

* * * * *